United States Patent [19]

Finkl

[11] Patent Number: 4,597,742

[45] Date of Patent: Jul. 1, 1986

[54] TRIMMING ARRANGEMENT FOR PLANING HULLS

[76] Inventor: Charles W. Finkl, 2011 Southport Ave., Chicago, Ill. 60614

[21] Appl. No.: 362,706

[22] Filed: Mar. 29, 1982

[51] Int. Cl.[4] ..... B63H 21/26

[52] U.S. Cl. ..... 440/61; 114/284; 114/286; 440/65; 440/71

[58] Field of Search ..... 114/280, 282, 284–287, 114/274, 126; 440/61, 63, 65, 71, 66

[56] References Cited

U.S. PATENT DOCUMENTS

| | | | |
|---|---|---|---|
| 1,538,802 | 5/1925 | Harley | 440/63 |
| 2,076,603 | 4/1937 | Svendsen | 440/71 X |
| 2,415,183 | 2/1947 | Law | 440/63 X |
| 2,832,304 | 4/1958 | Elyosius et al. | 114/280 |
| 2,961,988 | 11/1960 | Wood | 440/65 |
| 2,967,503 | 1/1961 | Unger | 114/126 X |
| 3,104,642 | 9/1963 | Piazza | 114/280 X |
| 3,342,155 | 9/1967 | Hook | 114/280 |
| 3,399,643 | 9/1968 | Bennett | 114/285 |
| 3,698,343 | 10/1972 | Boome | 114/285 |
| 3,933,116 | 1/1976 | Adams et al. | 440/61 X |
| 4,193,366 | 3/1980 | Salminen | 114/280 X |

*Primary Examiner*—Sherman D. Basinger

*Attorney, Agent, or Firm*—Baker & McKenzie

[57] ABSTRACT

An improved trimming arrangement is disclosed which is particularly suited for use with a craft having planing hull with a marine drive. In one embodiment, the trimming arrangement includes a submerged trim hydrofoil which is affixed to the drive housing of the drive system beneath the screw propeller drive shaft. So that the efficiency of the planing hull and drive system are improved at hull-planing speeds, the trim hydrofoil is positioned to create a downward force component of the stern of the planing hull during forward movement through the water. The bow of the hull is thereby urged upwardly, thus minimizing the wetted area of the hull and improving its efficiency. In a further embodiment, the trimming arrangement includes a selectively adjustable submerged hydrofoil pivotably mounted to the transom of the planing hull which is operable to provide the desired downward force component on the stern of the hull. In a yet another embodiment, the trimming arrangement is provided by a modification of adjustable trim plates frequently used on planning hulls, so that the desired operational characteristics of the present invention are achieved with minimal expense and modification of the craft.

7 Claims, 12 Drawing Figures

TRIMMING ARRANGEMENT FOR PLANING HULLS

TECHANICAL FIELD OF THE INVENTION

The present invention relates generally to planing hulls, and more particularly to an improved trimming arrangement particularly suited for a planing hull having a partially submerged stern drive.

BACKGROUND OF THE INVENTION

Boats having planing hulls are designed to operate most efficiently at speeds where the hull planes on top of the surface of the water, and a minimum area of the hull is wetted. Typically, about one-half to two-thirds of the hull area is wetted at planing speeds; however, the wetted area may vary. Depending upon the design, as much as one-half of the hull area may be wetted at lower speeds, or as little as one-fourth of the hull wetted during very high speed cruising.

The type and configuration of a water craft's propulsion system greatly affects the planing characteristics of its hull. This is because the thrust force vector of the propulsion system may include force components which act about the center of gravity of the boat to affect the planing attitude of the hull. Ideally, the most efficient propulsion and hull arrangement will have propeller thrust and hull resistance forces acting substantially parallel to one another, and a minimum wetted hull area.

The original inboard marine propulsion systems having an essentially straight, direct drive between the inboard engine and the screw propeller are typically configured so that force components created by the propeller thrust adversely affect the planing characteristics of the boat hull. This is because the angular disposition of the propeller drive shaft with respect to the boat hull produces a upward as well as forward force component on the hull. The effect of the upward force component is to raise the stern of the hull and rotate the hull about the center of gravity of the boat. As the stern of the hull is raised with an increase in propulsion power and speed of the craft, rotation of the hull about the center of gravity of the boat creates a "bow down" attitude, thus creating a bow wake and appreciably reducing speed and efficiency of the craft due to increased wetted area. Thus, direct drive inboard propulsion systems have not proved to be the most effecient system for use with planing hulls. On the other hand, planing hulls having outboard engine propulsion systems are not similarly adversely affected since the center of thrust of the system is disposed parallel to the planing axis of the craft, and the center of gravity of the boat is as far astern as possible with the outboard engine mounted on the transom of the hull.

Because inboard propulsion systems permit the use of relatively larger power plants than outboard arrangements, and provide the security and accessibility of an onboard installation, various attempts have been made to improve the planing characteristics of boats having inboard drive. One approach has been to use a so-called "V-Drive" in which the inboard engine is mounted as far astern in the craft as possible. The drive shaft of the engine extends forwardly thereof, and is operatively connected with the downwardly and rearwardly extending propeller shaft by a gearbox. This arrangement improves upon the undesired "bow down" effect created by direct drive inboards by moving the center of gravity of the craft farther astern and reducing the downward angle of the propeller shaft. This reduces the bow down attitude, and places the center of gravity over a wider portion of the hull, thus improving lift of the hull and reducing the overall wetted hull area. However, this arrangement is more costly and somewhat less power-efficient than a comparable direct drive inboard since the gearbox "V-drive" connecting the engine drive shaft and propeller shaft reduces the ultimate power delivered to the propeller shaft.

In order to combine the desirable characteristics of inboard drives and outboard drives, so-called inboard-outboard, or Z-Drives have been developed and are in very widespread use today. The engine of this system is mounted inboard of the hull near its stern, and is connected by a suitable drive train with a propeller drive housing mounted on the transom and extending rearwardly thereof. This system desirably places the center of gravity of the craft as far astern as possible, while at the same time permitting positioning of the drive housing so that the center of propeller thrust is parallel with the planing axis of the hull.

A significant development for inboard-outboard drives has been the introduction of arrangements for altering the angular disposition of the propeller drive housing during operation of the craft, thus permitting trimming of the hull to improve its planing characteristics. This is typically provided by an arrangement whereby the lower portion of the propeller drive housing may be moved fore and aft by rotation about a pivot point above the waterline. In this way, the thrust force vector of the propeller may be selectively directed so that a force component is created which urges the stern of the craft downwardly. As the craft rotates about its center of gravity due to this downward force component on its stern, the bow of the craft is lifted, thus improving efficiency of the hull and increasing top speed. A further advantage of the inboard-outboard drive system is that the center of thrust of the propeller is disposed parallel to the planing axis of the hull, and below the center line of hull resistance, thereby creating a rotating couple which tends to raise the bow of the hull as power and speed increase.

One of the most recent developments in propulsion systems for planing hulls is the so-called surface-piercing drive, or surface drive. This system is similar to inboard-outboard drives in that the engine of the system is disposed inboard of the hull, while the propeller drive housing is mounted on the transom of the hull and extends rearwardly thereof. The drive housing is mounted on the transom by a ball-and-socket type joint with the propeller drive shaft connected with engine output shaft by a universal joint, thus permitting the housing to be pivoted both vertically and laterally. Hydraulic actuators extend between the drive housing and the transom of the hull for selective positioning of the housing, in this way effecting both steering and trimming functions.

In significant distinction from typical inboard-outboard drives, the new surface drives are designed so that the screw propeller of the system is only partially submerged during optimum operating conditions of the craft. In this way, drag created by the drive housing and propeller itself are greatly reduced as compared with inboard-outboard drives, resulting in greater overall efficiency and speed. The propeller slippage factor for this type of drive is comparable to or slightly higher than that of a drive having a fully submerged propeller.

As discussed, the trimmable nature of recent Z-Drive propulsion systems permit adjusting of the drive housing for the most efficient planing of the hull on the surface of the water by creating a downward force component on the stern of the hull. However, the nature of surface drive systems does not permit the creation of a similar downward force component. This is because movement of the surface drive housing to create a downward force component on the stern as with a Z-Drive (i.e. pivoting of the Z-Drive housing rearwardly) results in the propeller of the surface drive being moved out of the water. Obviously, this results in an immediate loss of speed and efficiency, since these types of drive systems are designed for maximum efficiency when the screw propeller is about half-submerged.

Accordingly, a trimming arrangement suited for use with a marine drive system incorporating a partially submerged screw propeller (surface drive) which permits creation of a downward force component on the stern of the planing hull of the craft for improving its planing characteristics is desirable and further enhances the performance of surface marine drive systems.

SUMMARY OF THE INVENTION

The present invention contemplates an improved adjustable trimming arrangement for a planing hull. The trimming arrangement is suited for use with a marine drive system which includes a drive housing mounted on the stern of the planing hull for adjustable movement with respect thereto, but may be adapted for use with planing hulls having other types of marine drives as well. The trimming arrangement of the present invention may be mounted either directly or indirectly on the planing hull, which mounting possibilities greatly enhance the versatility of the arrangement.

The present trimming arrangement includes at least one submerged hydrofoil means having water-reactive surfaces. The hydrofoil is mounted either directly or indirectly on the planing hull for selective adjustable movement with respect thereto. The hydrofoil acts to create a downward force component which acts upon the stern of the planing hull during forward movement of the hull through water. Thus, the desirable "bow up" condition for the hull is created, significantly enhancing the efficiency as well as other operational characteristics of the hull.

In one embodiment, the trimming arrangement includes submerged hydrofoil means affixed to the drive housing of the marine drive system, and is disclosed as part of a surface marine drive system, the drive housing of the system being mounted on the transom of the planing hull by a ball-and-socket type joint. In other embodiments, the present trimming arrangement is mounted on the transom of the planing hull, separate from the drive system of the hull.

The marine drive system which incorporates the first embodiment of the present trimming arrangement includes a propeller drive shaft rotatably supported by the drive housing and carrying a screw propeller, preferably of the type adapted to operate partially submerged to reduce the downward angle of the propeller shaft and also reduce the draft of the hull. The drive shaft is operatively connected with an associated marine engine for propelling the planing hull.

In this embodiment, the novel trimming arrangement is disposed on the drive housing below the propeller drive shaft. Preferably, the trimming arrangement includes a submerged hydrofoil mounted on a lower skeg of the drive housing for selectively adjustable movement. During forward movement of the hull through water, the hydrofoil of the trimming arrangement reacts with the water to create a downward force component which acts through the drive housing on the stern of the planing hull. In this way, a desirable, adjustable "bow up" condition is created as the craft approaches cruising speeds, thus improving the planing characteristics of the hull by minimizing its wetted area. Significantly, this effect is possible even though the marine drive for the hull is of the surface-piercing type, thus obviating the problem of effective trimming of the hull for efficient planing with this particular type of marine drive.

In a further embodiment, the trimming arrangement embodying the present invention is adapted for mounting on the transom of the planing hull separate from the marine drive system for that hull.

In this particular embodiment, the trimming arrangement includes a submerged hydrofoil affixed to the hull transom and mounted for pivotal movement about a horizontal axis generally parallel to the transom of the hull. Actuating means, such as a suitable hydraulic actuator, is provided operatively associated with the hydrofoil for selective adjustment of the angular disposition of the foil with respect to the hull during operation of the craft. Preferably, the submerged hydrofoil and its associated actuator are mounted to the exterior of the hull, thus eliminating the risk of hull leakage and avoiding problems of space limitations which must be considered with marine equipment mounted inboard of the planing hull.

In another, further embodiment of the present trimming arrangement, submerged hydrofoil means are provided which are adapted for association with trim plates (sometimes referred to as boat levelers) typically affixed to respective opposite sides of the transom of a planning hull. Trim plates permit selective adjustment of the planing characteristics of a hull during operation at planing speeds, and are employed to compensate for listing of the hull.

In this embodiment of the present trimming arrangement, the attachment of a submerged hydrofoil to each of the trim plates of the planing hull provides desirable, adjustable trim characteristics for the hull, including the creation of a downward force component on the stern of the hull, in a straightforward manner. Since many planing hulls include adjustable trim plates of the above description mounted on the transom, the desirable features of the present invention may be achieved with minimal expense and modification of the craft.

In each of the above embodiments, the hydrofoil of the trimming arrangement includes a leading edge that recedes rearwardly. That is, the hydrofoil preferably has a generally wedge-shaped configuration. In this way, the hydrofoil tends to be "weedless". In other words, solid material contacting the hydrofoil during forward movement of the craft tends to be directed outwardly of the hydrofoil. Additionally, the trailing edge portion of the hydrofoils may be shaped so as to provide an upwardly extending tab portion with respect to the remainder of the hydrofoil surface. In this way, a greater downward force component may be exerted on the stern of the hull. Additionally, this configuration may be designed to direct a stream of water toward the screw propeller when the trimming arrangement is mounted on the drive housing of the drive system of the planing hull.

Numerous other advantages and features of the present invention will become readily apparent from the following detailed description of the invention and embodiments thereof, from the claims, and from the accompanying drawings in which like numerals are employed to designate like parts throughout the same.

DETAILED DESCRIPTION OF THE DRAWINGS

Figure 1:
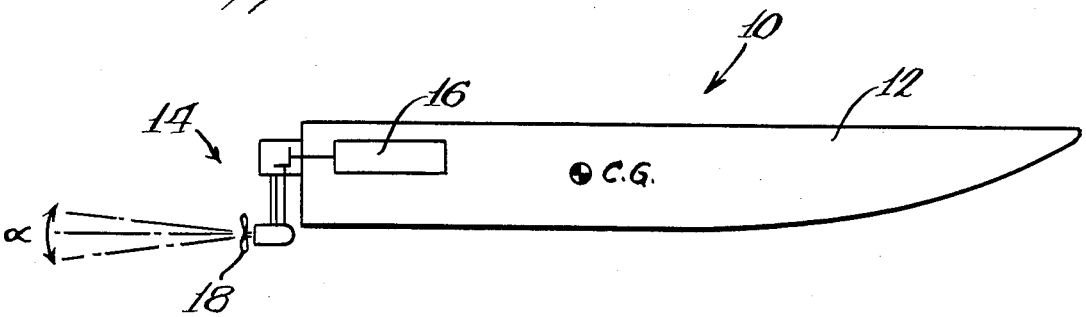
FIG. 1 illustrates a typical inboard-outboard marine drive system having a Z-Drive.

While the present invention is susceptible to embodiment in various forms, there are shown in the drawings and will hereinafter be described various embodiments with the understanding that the present disclosure is to considered as an exemplification of the invention and is not intended to limit the invention to the specific embodiments illustrated.

With reference to the drawings, FIG. 1 is a simplified illustration of a boat 10 having a typical inboard-outboard Z-Drive marine propulsion system. Boat 10 includes a planing hull 12, with a drive housing 14 mounted on the transom at the stern of the craft. The drive system includes inboard engine 16 which drives a normally fully submerged screw propeller 18 carried by a propeller shaft housing 20. As indicated by the adjacent double-ended arrow, propeller shaft housing 20 is pivotable fore and aft with respect to planing hull 12. In this way, the center line of propulsion thrust may be varied throughout the indicated angle "alpha". Movement of shaft housing 20 is this fashion allows hull 12 to be trimmed during operation of the craft to enhance the planing characteristics of the hull. Specifically, shaft housing 20 may be pivoted rearwardly so that its thrust force vector includes a force component which acts through the housing to urge the stern of planing hull 12 downwardly, thus rotating the hull about its center of gravity. This results in the bow of hull 12 desirably rising, thereby improving the planing characteristics of the hull so that the wetted area of the hull is minimized. It will be appreciated that another advantage of the typical Z-Drive propulsion system illustrated in FIG. 1 is the disposition of the center of propeller thrust parallel to the planing axis of the hull, and below the center line of hull resistance. This configuration sets up a rotating couple further tending to raise the bow of the hull as the speed of the craft increases. However, such trim adjustment, while desirable, heretofore has not been possible with surface drive-equipped boats.

Figure 2:
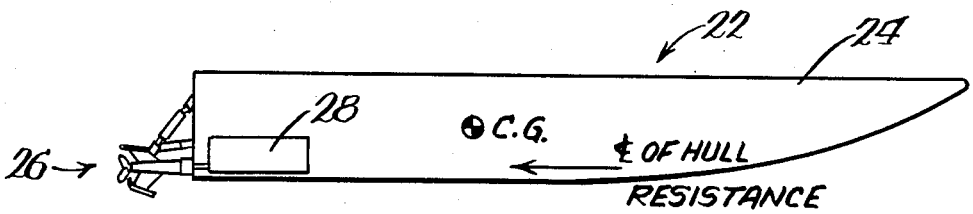
FIG. 2 illustrates a surface marine drive system embodying the present invention.

With reference to FIG. 2, surface drive boat 22 illustrates the surface drive propulsion system that embodies the present invention. Boat 22 includes a planing hull 24 and a surface drive propulsion system 26. One type of surface drive system currently available is the Arneson drive, marketed by Warner Gear, Muncie, Indiana. Inboard motor 28 provides power for the drive system.

Figure 3:
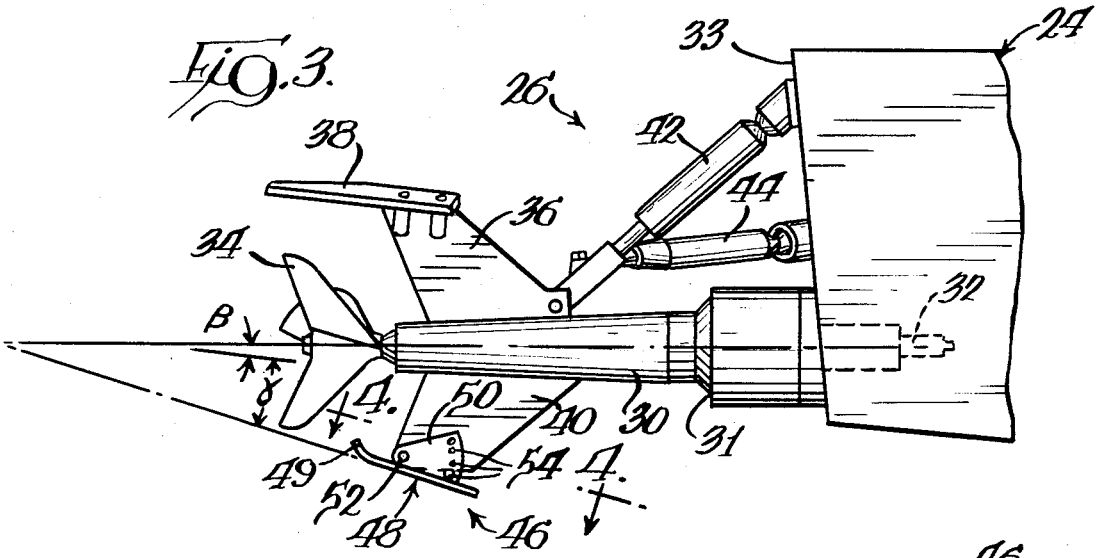
FIG. 3 is a detailed fragmentary and enlarged view of the surface marine drive system illustrated in FIG. 2.

As shown in greater detail in FIG. 3, surface drive 26 includes an elongated drive housing 30 mounted by ball-and-socket joint 31 on transom 33 of hull 24. This mounting permits the drive housing to be pivoted both vertically and laterally of hull 24 thus providing steering functions and some trimming ability. The drive housing rotatably supports propeller shaft 32 upon which is mounted surface-piecing screw propeller 34. Shaft 32, which typically includes two segments connected by a universal joint which is disposed within ball-and-socket joint 31, is suitably universally connected with the output shaft of inboard motor 28 (FIG. 2). As is characteristic of marine surface drive systems, surface-piecing propeller 34 is designed for propelling the craft at optimal efficiency when the propeller is only partially submerged, with usually about one-half or less of the propeller disposed above the surface of the water.

Surface drive 26 further includes an upper skeg 36 extending upwardly from drive housing 30 and supporting an anti-cavitation and protection plate 38. For desired stability and propeller protection, a lower skeg 40 extends downwardly from drive housing 30. Selective vertical positioning of drive housing 30 is provided by trim actuator 42, which may typically comprise a hydraulically actuated piston and cylinder. Selective lateral movement of drive housing 30 for steering boat 22 is provided by steering actuator 44 extending between drive housing 30 and transom 33.

As shown in FIG. 2, surface drive 26 is typically positioned so that its centerline of propeller thrust is nearly coincident with the centerline of resistance of hull 24, or, depending upon the angle of propeller shaft 32, slightly above the centerline of resistance. As drive housing 30 is rotated in a vertical plane about ball-and-socket joint 31 by trim actuator 42 as boat 22 is driven forward, hull 24 may be quickly planed, if desired, with drive housing 30 tilted downwardly, and maintained in a planing condition at the lowest possible speed while drive housing 30 is in the downward position. However, unlike the Z-Drive craft illustrated in FIG. 1 in which propeller shaft housing 20 may be pivoted rearwardly so that the stern of the craft is urged downwardly, movement of drive housing 30 of surface drive 26 so that the line of propeller thrust is angled upwardly merely lifts screw propeller 34 out of the water, thus reducing propeller thrust and providing no appreciable forward force component on the stern.

Figure 4:
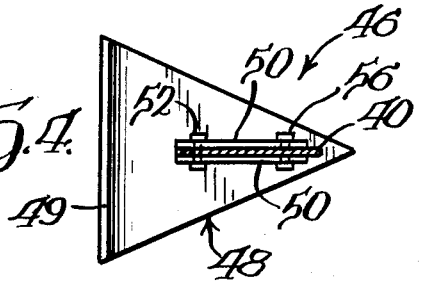
FIG. 4 is a view partially in section and taken along plane 4—4 of FIG. 3.

In accordance with the present invention, surface drive 26 is adapted to provide the desired downward force component on the stern of hull 24 by inclusion of trimming arrangement 46. In this embodiment, trimming arrangement 46 includes submerged hydrofoil 48 which extends transversely of drive shaft 32 and is mounted on lower skeg 40 of drive housing 30, preferably for selective adjustable movement with respect thereto. As best shown in FIGS. 3 and 4, mounting plates 50 are affixed to the surface of hydrofoil 48. In the illustrated embodiment, plates 50 are attached to lower skeg 40 by a mount pivot 52; however, other attachment means can be employed, such as cast, welded or flush fittings.

Mounting plates 50 define a plurality of adjustment holes 54, with an adjustment pin 56 extending through one of holes 54 in each plate 50 and lower skeg 40. In this way, the angular disposition of hydrofoil 48 may be selectively varied so that the dynamic characteristics of the trimming arrangement may be optimized for a particular hull or conditions. It will be appreciated that hydrofoil 48 could be similarly adjusted by use of a suitable hydraulic, mechanical or servo linkage. Alternatively, hydrofoil 48 may be hydraulically, mechanically, or servo linked for adjustment in conjunction with vertical movement of drive housing 30.

As best shown in FIG. 4, the configuration of hydrofoil 48 is preferably wedge-shaped, tapering rearwardly and outwardly. Its leading edge recedes rearwardly from the centerline, thus providing the hydrofoil with desirable "weedless" characteristics. As shown, hydrofoil 48 is configured substantially as an isosceles triangle, but it will be appreciated that other generally planar surface geometries having a rearwardly (i.e., in a direction from fore to aft) and outwardly tapering leading edge are suitable.

A further feature of hydrofoil 48 is the disposition of its trailing edge portion 49. Specifically, a trailing edge portion of the hydrofoil preferably extends upwardly, angularly or otherwise, with respect to the remainder of the generally planar surface of the hydrofoil. If desired, trailing edge portion 49 of hydrofoil 48 may be independently adjustable so that the dynamic characteristics of the hydrofoil may be "fine tuned". Additionally, this disposition of the trailing edge portion of the hydrofoil enables the trimming arrangement to provide a greater downward force component on the stern of hull 24: (1) due to the increased angle of incidence of hydrofoil; (2) due to the differential pressure of the upper and lower reactive surfaces of the hydrofoil since the velocity of water across the lower surface is greater than the velocity across the upper surface; and (3) due to acceleration of water flow at the trailing edge 49 increasing the downward force component.

It will be appreciated that upwardly extending trailing edge portion 49 may extend across the entire hydrofoil 48, or may extend across only a portion of its rearward edge. If desired trailing edge portion 49 may be arranged to direct more water to screw propeller 34 with attendant greater efficiency of the drive system. Of course, it will be appreciated that improved trimming characteristics provided by the present invention may be realized by use of an essentially flat hydrofoil 48 which does not have an upwardly extending trailing edge portion.

The force component created by hydrofoil 48 is related to forward velocity of boat 22 in accordance with Bernoulli's principle, and thus downward thrust is a function of velocity squared. Because the vertical thrust component created by screw propeller 34 is a linear function with respect to velocity of boat 22, the dynamic effects of hydrofoil 48 overcome the vertical propeller thrust component as speed of the boat increases. In practice, it is contemplated that the arrangement of the drive system embodying the present invention will become effective in reducing specific fuel consumption at speeds over 20 miles per hour (m.p.h.) when hull efficiency becomes critical. It is desirable to keep the line of propeller thrust as close to the planing axis of planing hull 24 as possible, thus the use of hydrofoil 48 to obtain effective bow lift is preferable to the use of excessive propeller shaft angles. The exponential force characteristics of the hydrofoil enhance its effectiveness, in contrast to the negative effects resulting from raising a surface drive screw propeller out of the water, which results in loss of horizontal propeller thrust, and detracts from the stability, handling characteristics, and fuel economy of the craft.

When fine tuning the angle of hydrofoil 48 and the disposition of its trailing edge portion 49 for optimal operating characteristics, it is possible to maintain a nearly horizontal centerline of thrust while still obtaining the desirable bow lift at points of maximum efficiency and/or maximum speed. It has been found that this fine tuning or trim of the hydrofoil will have little or no effect at lower speeds of boat 22 when a bow up attitude for hull 24 is not desirable. Significantly, the drive housing 30 of a marine drive such as surface drive 26 may be moved upwardly or downwardly approximately one to two degrees without appreciably altering the attitude or speed of hull 24 as a result of the change in the force components of screw propeller 34. However, these minor variations in the disposition of the drive housing appreciably alter the vertically oriented force components of the hydrofoil 48. Thus, hydrofoil 48 may be fixedly mounted on driving housing 30, and "fine-tuning" of the trimming charcteristics effected by minor alterations in the angular disposition of drive housing 30.

A further feature of the present invention regards installations having dual marine drives. Where each marine drive is provided with an embodiment of the present invention, each hydrofoil 48 provides a desirable stabilizing effect at lower speeds, particularly in rolling water conditions.

A sample calculation illustrates the effectiveness of the present drive system. Assume the craft to be driven has a 29-foot hull, the center-of-gravity of the craft is 9 feet from the stern, and includes twin engines each providing 300 horsepower (hp) to a respective screw propeller driving the craft at a speed of 70 m.p.h.

If the craft has a surface drive system (as in FIGS. 2 and 3 without the present trimming arrangement) in which the drive housing has a downward drive angle "beta" of 6 degrees, the upward force component on the stern of the craft may be calculated as follows:

$$(300\text{ hp})\frac{(550\text{ ft.} - \text{lbs./sec.})}{\text{hp}} = 165{,}000\text{ ft.lbs./sec./engine}$$

$$70\text{ m.p.h.} = 103\text{ ft./sec.}$$

$$\text{Propeller thrust} = \frac{165{,}000\text{ ft.} - \text{lbs./sec.}}{103\text{ ft./sec.}} = 1602\text{ lbs./engine}$$

$$\begin{aligned}\text{Vertical Thrust Component (for 6 degrees trim aft)} &= (\text{Tangent } 6^\circ)(\text{Propeller thrust})\\ &= (0.105)(1602)\\ &= 168\text{ pounds/engine}\end{aligned}$$

Thus, the upward, vertical thrust component of the surface drive is 168 pounds at the stern of the hull for each engine.

For the same craft having the surface drive embodying the present invention for each engine, including a 10 inch by 10 inch hydrofoil having the configuration of a isosceles triangle and angled downwardly 6 degrees ("gamma") to the planing angle, the downward thrust component created at 70 m.p.h. is as follows:

Area of hydrofoil $=\frac{1}{2}$(base)(height)$=50$ in.$^2$

Velocity head on hydrofoil surface at 70 m.p.h.$=70$ lbs./in.$^2$ of area

Vertical force component of each hydrofoil due to 6 degree angle of incidence$=$(Velocity head)(area)(tan 2°) $=$(70 lbs./in.$^2$) (50in.$^2$)(0.105) $=368$ pounds The effectiveness of the present drive system is readily apparent, since it provides a downward force component for improved planing characteristics which is more than twice the upward force component created by a conventional surface-piercing drive, yet still offers the improved efficiency associated with the low drag characteristics of surface-piercing marine drives.

Figure 5:
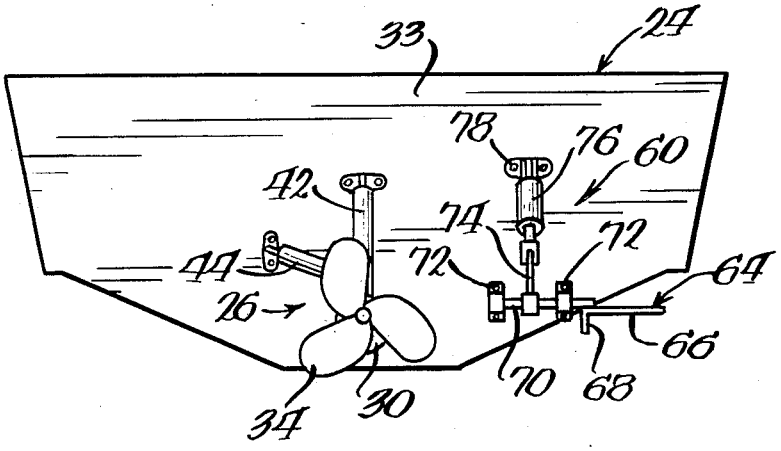
FIG. 5 is a rear elevational view of a planing hull illustrating a further embodiment of the present invention mounted thereon.
Figure 6:
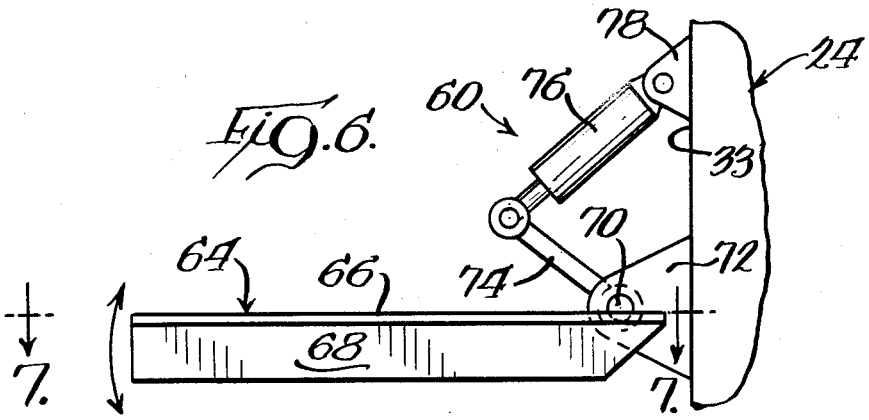
FIG. 6 is an enlarged, fragmentary side elevational view of the embodiment of the present invention illustrated in FIG. 5.
Figure 7:
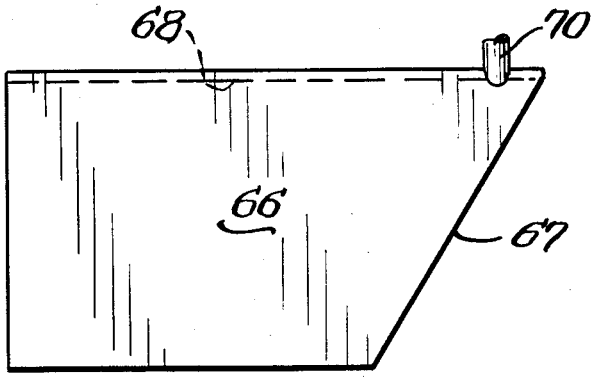
FIG. 7 is a view taken along plane 7—7 of FIG. 6.
Figure 8:
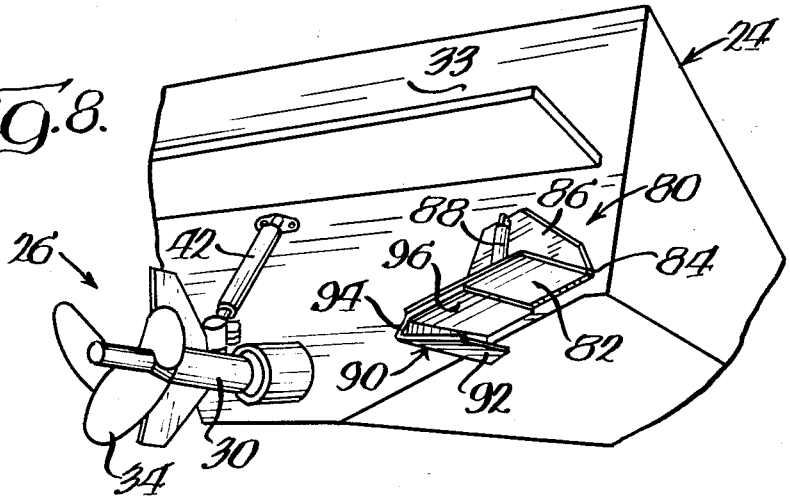
FIG. 8 is a partial perspective view of the stern of a planing hull illustrating a further embodiment of the present invention.
Figure 9:
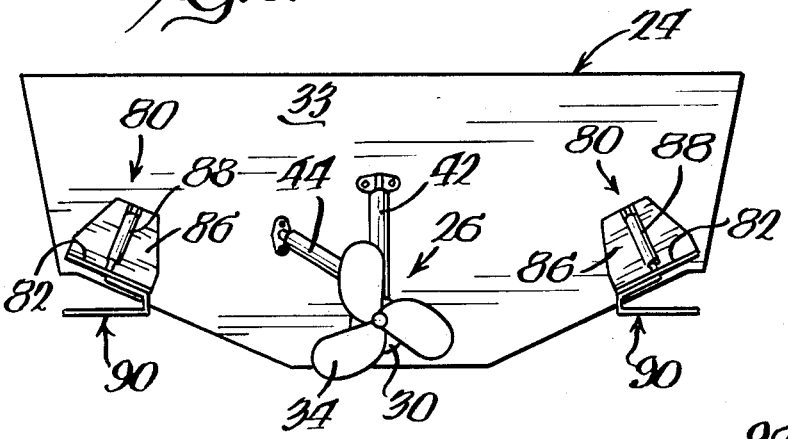
FIG. 9 is a rear elevational view of the planing hull illustrated in FIG. 8.
Figure 11:
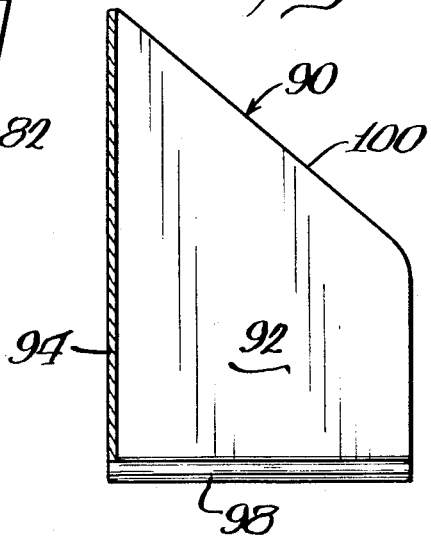
FIG. 11 is a view partially in section taken along plane FIG. 10.
Figure 10:
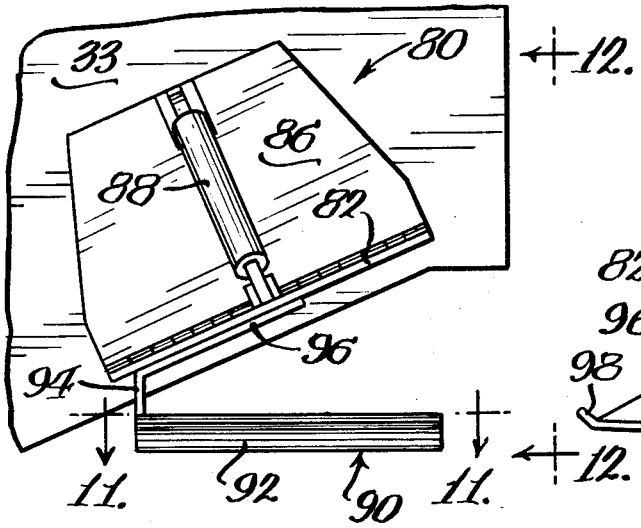
FIG. 10 is a fragmentary, enlarged rear elevational view of the embodiment of the present invention illustrated in FIG. 8.

With reference now to FIGS. 5–7, a further embodiment of the present trimming arrangement for planing hulls is illustrated. In this embodiment, previously described planing hull 24, including marine surface drive 26, is provided with an adjustable trimming arrangement 60 affixed to the transom 62 at the stern of hull 24 for providing the desired creation of a downward force component on the stern of the hull during forward movement of the hull through water, in accordance with the principles of the present invention.

Trimming arrangement 60 includes submerged hydrofoil 64 having water-reactive surfaces which is pivotally mounted on transom 62 of hull 24 for pivotal movement with respect thereto. Hydrofoil 64 includes a generally horizontally disposed, generally planar first portion 66 having a rearwardly receding leading edge portion 67 to provide the hydrofoil with "weedless" characteristics. Hydrofoil 64 preferably further includes a generally vertically disposed stabilizing second portion 68, which in this embodiment extends generally perpendicularly downwardly from the inboard edge portion of planar portion 66.

Although not illustrated, planar portion 66 of hydrofoil 64 may include a trailing edge portion extending upwardly with respect to the remainder of the planar portion, such as trailing edge portion 49 of previously described hydrofoil 48.

In order to pivotally mount hydrofoil 64 on the transom 62 of hull 24 for adjustable movement with respect thereto, hydrofoil 64 is affixed and connected to a generally horizontally disposed transversely extending shaft 70. Shaft 70 is supported for pivotal movement on transom 62 by a pair of shaft mounting brackets 72.

Selective adjustment of hydrofoil 64 is provided by a suitable actuator 76 operatively connected with the hydrofoil by a linkage 74. Linkage 74 is in the manner of a crank arm, having one end affixed to shaft 70, with its opposite end pivotally connected to actuator 76. Actuator 76, which may comprise a hydraulic cylinder or the like, is pivotally supported on transom 62 of hull 24 by actuator mount 78.

Trimming arrangement 60 accommodates significant improvements in the trimming and operational characteristics of planing hull 24 in accordance with the present invention. It will be noted that in this embodiment of the present invention the desired operational characteristics are provided without modification of the marine drive system of the planing hull. Additionally, the fact that trimming arrangement may be mounted on the exterior of transom 62 of the hull obviates problems of leaking which might otherwise occur if operaticnal portions of trimming arrangement extended through the hull. Further, exterior mounting in this fashion avoids problems associated with space considerations when mounting equipment or mechanisms inside of the hull. It will be appreciated that in a typical planing hull space limitations are a major consideration in regards to installation of equipment near the rear of the hull, where the marine drive system and other equipment of the craft are typically located.

Like the previously described embodiment of the present invention, trimming arrangement 60 significantly enhances the trimming characteristics of planing hull 24, particularly when used in conjunction with a surface-piercing marine drive. The bow of planing hull 24 may be trimmed upwardly or downwardly by selective adjustment of the angle of incidence of hydrofoil 64 by pivotal movement of shaft 70 by operation of actuator 76 operating the hydrofoil through shaft link 74. In this way, the desired downward force component may be created which acts upon the stern of planing hull 24 in order to provide the desired "bow up" disposition of the hull with the creation of lateral force components which would at to steer the hull. As discussed, creation of this downward force component on the stern of planing hull 24 significantly enhances the planing characteristics of the hull, providing these improved planing characteristics even when planing hull 24 is equipped with a surface-piercing marine drive, such as marine drive 26.

It will be appreciated that longitudinal stability of planing hull 24 is enhanced by the inclusion of vertical stabilizing portion 68 of hydrofoil 64. Additionally, the disposition of trimming arrangement 60 on transom 62 as illustrated in FIG. 5 positions hydrofoil 64 in an accessible yet protected position, that is, above the bottom of hull 64 and inside the chine of the hull. Significantly, there is no wake created by hydrofoil 64 since it is completely submerged, this being an important consideration when the craft is used for towing water skiers.

While various types of stabilizing hydrofoils have been used on displacement hulls, trimming arrangement 60 overcomes many of the disadvantages typically associated with hydrofoils of this nature heretofore known. In a displacement hull, stabilizing hull hydrofoils are generally provided in the forward portion of the hull, but this results in increased rocking of the hull in and out of the water in rough seas. It will be appreciated that use of stabilizing hydrofoils on the forward portion of planing hulls has not proved practical since forwardly disposed hydrofoils are subject to damage by vertical pounding during high speed operation of the planing hull, or may be damaged due to striking docks or other obstacles due to the relatively narrow bow of planing hulls. Additionally, providing adequate structural support in a relatively small hull for a stabilizing hydrofoil which is forwardly mounted may be difficult if not impossible. Trimming arrangement 60 overcomes the problems typically associated with adaptation of forwardly mounted stabilizing hydrofoils to planing hulls by its disposition on transom 62 of hull 24, the transom of the hull typically being the strongest part thereof. Naturally, positioning trimming arrangement 60 on the transom also affords ready accessibility to the arrangement for service and adjustment if required.

A further embodiment of the trimming arrangement of the present invention is illustrated in FIGS. 8–12. In this embodiment, the desirable trimming and operational characteristics of the present invention are provided by modification of trimming equipment which may be already in place on the transom of the planing hull. Thus, this embodiment of the present invention provides the desired improved operational characteristics with minimal expense and modification of the craft.

Deep "V" hulls having a dead rise of ten to thirty degrees (commonly about twenty-four degrees) are very desirable for "off-shore" rough water use where the V-shaped configuration of the hull acts to cut through waves, thereby reducing impact on the hull. However, these types of hulls are very susceptible to cross-winds as the hull leans into the wind, and to eccentric loading when the hull leans to its heavy side. Should the angle of list be equal to the dead rise of the planing hull, it will be appreciated that the effect is that of a flat bottom boat, to the detriment of the desirable wave-cutting or "soft" riding characteristics of the hull as the flat side of the hull pounds into the sea.

In order to remedy this situation, trim plates, sometimes referred to as boat levelers, are provided on respective opposite sides of the transom of the hull close to the chines of the boat. FIGS. 8–12 illustrate trimming arrangements 80, including trim plates 82 of the above description pivotally mounted by pivots 84 to plate mounts 86 affixed to the transom 62 of the planing hull 24. Suitable actuators 88, usually hydraulically operated, operatively extend between plate mounts 86 and trim plates 82 for selective adjustment of the angular disposition of trim plates 82.

During operation, trim plates 82 may be selectively positioned by the operator of the craft in order to compensate for listing of the planing hull. Specifically, should the planing hull list to either its port or starboard sides, the trim plate mounted on that side of the hull is moved down by operation of one of the actuators 88, having the effect of righting the hull. However, it will be appreciated that trimming the hull in this fashion by operation of one of trim plates 82 acts to steer the hull, since the trim plates 88 are not horizontal, and set up a lateral component on the planing hull. Additionally, actuation of the trim plates in this manner undesirably lowers the bow of the planing hull due to the vertical force component created by operation of the trim plates which acts upon the stern of the hull. This "bow down" effect increases the wetted area of the hull thereby undesirably increasing its drag. Additionally, operation of the trim plates in the above manner creates a large wake detrimental to water skiers.

In this embodiment of the present invention, the trimming arrangements 80 disposed on respective opposite sides of transom 62 of planing hull 24 include the pivotally mounted trim plates 82 as described above, and further include submerged, water-reactive hydrofoils 90 which are affixed to trim plates 82 to provide the improved trimming and operational characteristics of the present invention. Trimming arrangements 80 are illustrated in conjunction with surface-piercing marine drive 26, as previously described, since the benefits of the present invention are particularly suited to planing hulls having this type of marine propulsion system. However, it will be appreciated that as with the previously described embodiments, this embodiment of the present trimming arrangement would be suited for use with planing hulls having various types of propulsion systems. As noted, this embodiment of the present invention provides the improved trimming characteristics which may be achieved by a straightforward modification of the trim plates which may already be installed on the planing hull of the craft.

Hydrofoils 90 each have a generally V-shaped configuration, and include a first generally horizontally disposed generally planar first portion 92 and a generally vertically extending vertical stabilizing second portion 94 extending generally perpendicularly upwardly from the inboard edge of planar portion 92. Each hydrofoil 90 preferably further includes a plate mount portion 96 which is adapted for affixing the hydrofoil to one of the trim plates 82, such as by suitable mechanical fasteners (not shown). While various configurations for hydrofoils 90 may be used, it will be appreciated that the arrangement shown may be readily fabricated, and facilitates secure and simple installation on trim plates 82 pivotally mounted on planing hull 24. Hydrofoils 90 are preferably fabricated from suitable corrosion-resistant material, such as stainless steel.

Figure 12:
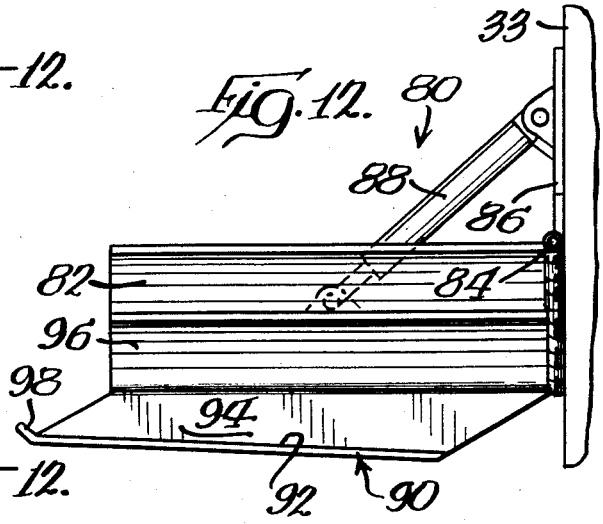
FIG. 12 is a view taken along plane 12—12 of FIG. 10.

As with previously described embodiments, the leading edge portion 100 of each hydrofoil 90 recedes rearwardly in order to provide each hydrofoil with "weedless" characteristics. Additionally, the trailing edge portion 98 of each hydrofoil 90 may extend upwardly with respect to the remainder of planar portion 92 in order to enhance the downward force component created by the hydrofoils which acts upon the stern of planing hull 24. As best shown in FIG. 12, planar portion 92 may be offset rearwardly somewhat of plate mount portion 96 to promote flow of water across the reactive surfaces of the hydrofoil during forward movement of planing hull 24.

In operation, hydrofoils 90 may be selectively adjustably positioned by selective operation of actuators 88 either independently or in unison. Because planar portion 92 of each hydrofoil 90 is generally horizontally disposed, operation of the hydrofoils to effect trimming of planing hull 24 by creation of a downward force component on the stern of the hull may be accomplished with minimal introduction of lateral force components on the hull, thus minimizing the steering effect associated with operation of conventional trim plate arrangements. Additionally, the submerged disposition of the reactive surfaces of hydrofoils 90 avoid the creation of undesirable wakes by the hydrofoils. As with the previous embodiment of the present invention, vertical stabilizing portion 94 of each hydrofoil 90 enhances the longitudinal stability of planing hull 24, thereby further enhancing the operational characteristics of the planing hull.

The foregoing is intended as illustrative but not limiting. Variations and modifications may be effected without departing from the true spirit and scope of the novel concept of the subject invention. No limitation with respect to the specific embodiments illustrated herein is intended or should be inferred. It is, of course, intended to cover by the appended claims all such modifications as fall within the scope of the claims.

What is claimed is:

1. An improved marine drive system for a planing hull comprising:

drive housing means adjustably mounted on the stern of said planing hull by a ball and socket mount extending aft of the stern transom, steering means for pivoting said housing means laterally of said hull about said mount, trimming means for pivoting said housing means vertically of said hull about said mount, a propeller drive shaft rotably carried by said housing means and having a screw propeller adapted to operate in a partially submerged condition for propelling said planing hull through water, and trim means mounted on said housing means below said drive shaft and positioned forward of said screw propeller, said trim means consisting of a hydrofoil whereby a downward force component is exerted on said drive housing during forward movement of said hull through water so that the stern of said hull is urged downward.

2. The marine drive system of claim 1, further including means for angularly adjusting said hydrofoil with respect to said housing means.

3. The marine drive system of claim 1, wherein a trailing edge portion of said hydrofoil extends upwardly from the remainder of the hydrofoil.

4. The marine drive system of claim 3, wherein the leading edge portion of said hydrofoil tapers rearwardly and outwardly.

5. An improved trimming arrangement for a planing hull, comprising:

submerged foil means mounted on the stern transom of said hull said foil supported from one side and positioned forward relative to a drive housing means for selective adjustable movement with respect thereto, said foil means having a configuration creating a downward force component which acts upon the stern of said planing hull during forward movement of said hull through water, means for pivotally mounting said foil means on said hull, actuator means operatively connected with said foil means for selectively varying the angular dispostion of said foil means to vary the resultant downward force component created thereby, said foil means comprise a pair of hydrofoils respectively pivotally mounted on opposite sides of the stern of said planing hull and extending rearwardly thereof, said actuator means comprise a pair of actuators respectively operatively connected with said hydrofoils for selected movement thereof, each of said hydrofoils includes a generally planar first portion disposed generally horizontally, and a generally vertically disposed second portion disposed generally perpendicular to said first portion, a pair of trim plate means pivotally mounted on respective opposite sides of the stern of said planing hull, said actuators being respectively operatively connected to said pair of trimplate means for selected pivotal movement thereof, and said hydrofoils being respectively affixed to said pair of trim plate means.

6. An improved trimming arrangement for planing hull having a marine drive system including a surface-piercing screw propeller, comprising:

a pair of trim plate means respectively pivotally mounted on opposite sides of the stern of said planing hull and extending rearwardly therof, a pair of submerged hydrofoil means pivotally connected to the stern of said planing hull by being respectively fixed to said pair of trim plate means, each of said hydrofoils having a generally V-shaped configuration and including a mounting portion affixed to the respective one of said trimplate means, a generally horizontally disposed generally planar portion disposed below said mounting portion, and a generally vertically disposed portion extending between and connecting on inboard edge of said planar portion to said mounting portion, each hydrfoil means being postionable for selectively creating a downward force component on the stern of said hull during forward movement of said hull through water for enhancing the planing characteristics of said hull, actuator means comprising a pair of actuators each respectively operatively connected with one of said trim plate means allowing select pivotal movement of said hydrofoil means with said hull.

7. The trimming arrangement of claim 6, wherein the generally planar portion of each of said hydrofoils includes a trailing edge portion which extends upwardly with respect to the remainder of said planar portion.

* * * * *